US007125914B2

(12) United States Patent
Chang

(10) Patent No.: US 7,125,914 B2
(45) Date of Patent: Oct. 24, 2006

(54) HEAT-CURED FURAN BINDER SYSTEM

(75) Inventor: Ken K. Chang, Dublin, OH (US)

(73) Assignee: Ashland Licensing and Intellectual Property LLC, Dublin, OH (US)

( * ) Notice: Subject to any disclaimer, the term of this patent is extended or adjusted under 35 U.S.C. 154(b) by 265 days.

(21) Appl. No.: 10/665,101

(22) Filed: Sep. 18, 2003

(65) Prior Publication Data

US 2005/0090578 A1 Apr. 28, 2005

(51) Int. Cl.
*B22C 1/22* (2006.01)

(52) U.S. Cl. ..... 523/144; 524/503; 524/557; 524/596; 524/612

(58) Field of Classification Search ..... 523/144; 524/503, 557, 596, 612
See application file for complete search history.

(56) References Cited

U.S. PATENT DOCUMENTS

| | | | | |
|---|---|---|---|---|
| 4,317,763 | A | 3/1982 | Menting | |
| 4,383,098 | A | 5/1983 | Menting | |
| 4,451,577 | A | 5/1984 | Coss | |
| 5,424,376 | A * | 6/1995 | Chang et al. | 525/480 |
| 5,516,859 | A * | 5/1996 | Dunnavant et al. | 525/504 |
| 5,607,986 | A | 3/1997 | Kim, deceased et al. | |
| 5,612,392 | A * | 3/1997 | Chang et al. | 523/144 |
| 5,856,375 | A * | 1/1999 | Chang et al. | 523/145 |
| 5,932,628 | A * | 8/1999 | Kiuchi et al. | 523/139 |
| 6,291,550 | B1 * | 9/2001 | Chen et al. | 523/142 |
| 6,391,942 | B1 * | 5/2002 | Chang et al. | 523/144 |
| 6,479,567 | B1 * | 11/2002 | Chang | 523/144 |
| 6,559,203 | B1 * | 5/2003 | Hutchings et al. | 523/142 |
| 6,593,397 | B1 * | 7/2003 | Chang | 523/144 |
| 6,979,567 | B1 | 12/2005 | Herron et al. | |

* cited by examiner

*Primary Examiner*—Kriellion Sanders
(74) *Attorney, Agent, or Firm*—David L. Hedden

(57) ABSTRACT

This invention relates to a heat-cured furan foundry binder system comprising a furan binder and a furan monomer or oligomer containing at least two terminal hydroxymethyl groups. The binders are particularly useful as warm-box binders, because they cure faster and foundry shapes (typically cores and molds) made with the binders exhibit higher tensile strengths than those made with conventional heat-cured furan binders.

7 Claims, No Drawings

HEAT-CURED FURAN BINDER SYSTEM

TECHNICAL FIELD OF THE INVENTION

This invention relates to a heat-cured furan foundry binder system comprising a furan binder and a furan monomer or oligomer containing at least two terminal hydroxymethyl groups. The binders are particularly useful as warm-box binders, because they cure faster and foundry shapes (typically cores and molds) made with the binders exhibit higher tensile strengths than those made with conventional heat-cured furan binders.

BACKGROUND OF THE INVENTION

Heat-cured furan binder systems are well known. Of particular interest are the so-called hot-box and warm-box binder systems. Hot-box furan binders typically comprise a furan, urea formaldehyde resin, and phenol formaldehyde resin. They are cured with an inorganic or organic salt at temperatures of 200° C. to 300° C. On the other hand, warm-box binder systems are typically comprised of a furan resin and furfuryl alcohol. They are cured with an inorganic or organic salt at temperatures of from about 100° C. to 300° C. Examples of warm-box binder systems are disclosed in U.S. Pat. Nos. 4,317,763, 4,451,577, and 4,383,098. These binders are preferred over hot-box binder for some applications because of their low formaldehyde content, low nitrogen content, higher tensile strength, lower binder usage level, availability of equipment, and the dimensional accuracy of the foundry shapes made with them.

Recently, improvements in warm-box binders have been made. Warm-box binder systems, which are nitrogen free, urea free, and essentially free of free formaldehyde, have been developed. Modifications of warm-box furan binders to increase their reactivity are also known. For instance, U.S. Pat. No. 5,607,986 discloses a binder comprising a phenol formaldehyde resin, modified furfuryl alcohol/formaldehyde resins, resorcinol pitch, and polyvinyl acetate to improve the reactivity of the warm box system. However, further improvements in these binders are still needed to improve their reactivity and the tensile strengths of cores made with them.

U.S. Pat. No. 6,391,942 relates furan no-bake binders comprising (a) a reactive furan resin, (b) furfuryl alcohol, (c) an activator selected from the group consisting of resorcinol, resorcinol pitch, and bisphenol A tar, (d) a bisphenol compound, (e) a polyol, and (f) a catalyst component comprising a catalytically effective amount of a halide of a transition metal. The patent discloses that the reactive furan may be a mixture of a conventional reactive furan and bis-hydroxymethylfuran.

All citations referred to in this patent application are expressly incorporated by reference.

BRIEF SUMMARY OF THE INVENTION

This invention relates to heat-cured furan binders comprising:

(a) a furan resin, (b) furfuryl alcohol, and (c) a furan monomer or oligomer containing at least two terminal hydroxymethyl groups, preferably a methylolated furan selected from the group consisting of di-methylolated furan, derivatives of di-methylolated furan, polymers of di-methylolated furan, and mixtures thereof, most preferably oligomers of bis-hydroxymethyl furan that contain at least 50% dimers thereof.

The binders can be used in warm-box and hot-box applications. However, the binders are particularly useful in warm-box applications, because they cure faster and exhibit higher tensile strengths than conventional furan warm box binders. This novel aspect of the invention relates to the use of methylolated furan selected from the group consisting of di-methylolated furan, derivatives of di-methylolated furan, polymers of di-methylolated furan, and mixtures thereof, preferably oligomers of bis-hydroxymethyl furan (BHMFO) that contain at least 50% dimers thereof, in combination with the other components of the heat-cured furan binder.

The advantages of using these binders over conventional heat-cured furan binders are as follows:

(1) The cure speed of binder (as evidenced by lower dwell times) is much faster than the cure speed of conventional heat-cured furan binder.

(2) The hot and cold tensile strengths of cores prepared by this invention are higher earlier on than the cores prepared with conventional heat-cured furan binders.

These advantages will benefit foundries, which require high productivity, because the cores can be handled sooner without breaking and the cycle time for producing the cores is reduced.

The advantages of the furan binder disclosed in U.S. Pat. No. 6,391,942 relate to improved casting quality. The patent, which relates to no-bake furan binders cured with an acid catalyst, rather than heat-cured furan binders cured with heat and a salt of an inorganic or organic curing catalyst, does not teach or suggest that the tensile strengths of cores and molds, produced with the binder, are improved by the addition of BHMFO. Furthermore, the patent requires that a polyol be used in the no-bake binder formulation. The subject binder does not require a polyol. If a polyol is used in the binder formulation, typically the amount of polyol used is less than 20 parts by weight based upon 100 parts of binder, preferably less than 5 parts by weight.

The binder is used to prepare foundry shapes, e.g. molds and cores, by mixing a minor amount of the binder with a major amount of foundry aggregate and a catalytically amount of a latent acid curing catalyst to form a foundry mix. The foundry mixes are used to prepare foundry shapes. The foundry shapes are cured in the presence of the latent acid curing catalyst, preferably copper tosylate, when they are heated at temperatures of about 100° C. to 300° C. The binder is cured by the application of radiant heat or heated generated by a microwave.

Metal castings can be prepared from the foundry shapes by methods well known in the art.

DETAILED DESCRIPTION OF THE INVENTION

The detailed description and examples will illustrate specific embodiments of the invention will enable one skilled in the art to practice the invention, including the best mode. It is contemplated that many equivalent embodiments of the invention will be operable besides these specifically disclosed. All units are in the metric system and all percentages are percentages by weight unless otherwise specified.

For purposes of this disclosure, a "warm-box binder system" is defined as a binder system comprised of a furan resin and furfuryl alcohol cured with a salt of an inorganic or organic acid curing catalyst at temperatures of from about 100° C. to 300° C. Such binder systems are well known in the art (see, for example, U.S. Pat. No. 5,607,986). A "hot box binder system" is defined as a binder system comprised of furan, urea formaldehyde, and phenol formaldehyde, which is cured at temperatures of 200° C. to 300° C. using ammonium nitrate or a sulfonic acid salt as curing catalysts.

The methyolated furans include di-methylolated furans having the following chemical structures:

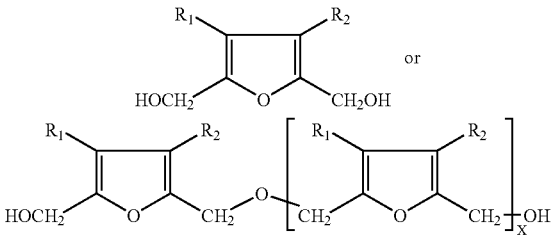

where "X=1, and where $R_1$ and $R_2$ are hydrogens, hydroxymethyl, alkylaral, aromatic, aliphatic or a substituted aliphatic groups such as alkyl, aralkyl, cycloalkyl, alkenyl, aralkenyl, alkynyl, aralkynyl, derivatives of di-methylolated furan, polymers of di-methylolated furan, and mixtures thereof, preferably oligomers of bis-hydroxymethyl furan that contain at least 50% dimers thereof.

Reactive furan resins that can be used in the process are preferably low nitrogen furan resins. The furan resins are prepared by the homopolymerization of furfuryl alcohol in the presence of heat, according to methods well-known in the art. The reaction temperature used in making the furan resins typically ranges from 95° C. to 105° C.

Preferably, the furan binder is a low nitrogen, modified-furan binder, which cures with a latent acid curing catalyst at temperatures of from about 100° C. to 300° C. For purposes of this disclosure, a "modified furan resin" is a furan resin which is made from furfuryl alcohol, urea formaldehyde oligomers, and formaldehyde at elevated temperatures under essentially acidic conditions at a pH of from 5.0 to 6.0, preferably 5.0 to 5.5. The weight percent of furfuryl alcohol used in making the nitrogen free modified furan resins ranges from 50 to 65 percent; the weight percent of the urea formaldehyde used in making the low nitrogen modified furan resins ranges from 10 to 35 percent; and the weight percent of the formaldehyde used in making the nitrogen free modified furan resins ranges from 1 to 20 percent, where all weight percents are based upon the total weight of the components used to make the modified furan resin.

The reaction temperature used in making the modified furan resins ranges from 95° C. to 105° C. The reaction is continued until the percentage of free formaldehyde is less than 3 weight percent, typically from 1 to 2 weight percent. The viscosity of the resin typically ranges from about 50 centipoise to 300 centipoise, and the refractive index is from 1.400 to about 1.600.

Although not necessarily preferred, urea-formaldehyde resins, phenol-formaldehyde resins, novolac resins, and phenolic resole resins may be used in addition to the furan resin.

The reactive furan resin is diluted with furfuryl alcohol to reduce the viscosity of the reactive ran resin and to improve the properties of the binder.

The heat-cured binders are made by combining the furan resin, furfuryl alcohol, and methylolated furan. The amounts of the components are from 5 parts by weight to 70 parts by weight furan resin, preferably from 10 parts by weight to 50 parts by weight; from 5 parts by weight to 70 parts by weight furfuryl alcohol, preferably from 10 parts by weight to 50 parts by weight; and from 5 parts by weight to 80 parts by weight methylolated furan, preferably from 10 parts by weight to 50 parts by weight, based upon 100 parts by weight of binder.

In general, any salt of a strong inorganic or organic acid, preferably inorganic acid, typically an acid having a pH<2, can be used as the curing catalyst. Examples of salts of inorganic acids, which can be used, are ammonium chloride, ammonium sulfate, ammonium nitrate, aluminum perchlorate, cupric perchlorate, and chromic perchlorate. Examples of salts from organic acids include copper phenol sulfonate, aluminum toluene sulfonate, zinc phenol sulfonate, and copper tosylate, and the like, most preferably copper toluene sulfonate. The amount of curing catalyst used is the amount required to result in foundry shapes, which can be handled without breaking. Generally, this amount is from 1 parts to 45 parts, preferably from 10 parts by weight to 40 parts by weight, most preferably 15 parts by weight to 35 parts by weight, based upon 100 parts binder.

The binders are typically cured at temperatures of from 100° C. to 300° C.

Preferably, the heat-cured binder contains a silane. Examples of silanes, which can be used in the binder, are represented by the following structural formula:

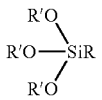

wherein R' is a hydrocarbon radical and preferably an alkyl radical of 1 to 6 carbon atoms and R is an alkyl radical, an alkoxy-substituted alkyl radical, or an alkyl-amine-substituted alkyl radical in which the alkyl groups have from 1 to 6 carbon atoms. The silane is typically used in amounts of 0.1 part by weight to 2 parts by weight, preferably from 0.1 part by weight to 0.5 part by weight based upon 100 parts binder.

Examples of some commercially available silanes are Dow Corning Z6040 and Union Carbide A-187 (gamma glycidoxy propyltrimethoxy silane); Union Carbide A-1100 (gamma aminopropyltriethoxy silane); Union Carbide A-1120 (N-beta(aminoethyl)-gamma-amino-propyltrimethoxy silane); and Union Carbide A-1160 (Ureido-silane).

The binder may contain an activator, which promotes the polymerization of furfuryl alcohol. The activator a tar selected from the group consisting of resorcinol pitch, bis phenol A tar, and mixtures thereof, preferably resorcinol. Bisphenol A tar is defined as the highly viscous product, which remains on the bottom of the reaction vessel after bisphenol A is produced and distilled from the reaction vessel. Bisphenol A tar is a solid at room temperature and has a melting point of about 70° C. to 80° C. Bisphenol A tar is mostly dimers, trimers, and polymeric bis phenol A. It may also contain substituted materials.

A mixture of bisphenol A tar and resorcinol pitch can be used to modify the binder in an amount such that the ratio of bisphenol A tar to resorcinol pitch is from 3:1 to 1:3, most preferably about 1:1. The bisphenol compound used is bisphenol A, B, F, G, and H, but preferably is bisphenol A. The amount of bisphenol A tar used is typically from 1 part by weight to 10 parts by weight based upon 100 parts of binder.

The binder may also contain polyvinyl acetate. Typically the polyvinyl acetate used has a molecular weight average of from about 1,000 to about 100,000, preferably from about 5,000 to about 25,000. A typical viscosity of the polyvinyl acetate, in any appropriate solvent (such as benzene) when required, is about 1 centipoise to about 25 centipoise, preferably about 1 centipoise to about 5 centipoise. The amount of polyvinyl acetate used is typically from 1 part by weight to 10 parts by weight based upon 100 parts of binder.

Although not required, bench life extenders may also be added to the binder formulation. Examples of bench life extenders include alkaline earth metal carbonates such as magnesium carbonate, calcium carbonate, and barium carbonate, and alkaline earth metal oxides such as magnesium oxide, calcium oxide, and barium oxide, preferably calcium carbonate. The particle size of the bench life extender typically is from about 0.5 micron to about 25 microns, preferably from about 1 micron to about 10 microns. It has been found that the use of the bench life extender in amounts of from 0.01 to 1.0 weight percent of the thermosetting resin, preferably 0.05 part by weight to 0.5 part by weight, most preferably 0.05 part by weight to 0.1 part by weight, are effective. Although more bench life extender can be used, this is unnecessary in most cases and only increases the cost of the binder without a significant increase in benefits, and in some cases may even decrease the bench life of the foundry mix.

It will be apparent to those skilled in the art that other additives such as release agents, solvents, etc. can be used and may be added to the binder composition, aggregate, or foundry mix.

The aggregate used to prepare the foundry mixes is that typically used in the foundry industry for such purposes or any aggregate that will work for such purposes. Generally, the aggregate will be sand, which contains at least 70 percent by weight silica. Other suitable aggregate materials include zircon, alumina-silicate sand, chromite sand, and the like. Generally, the particle size of the aggregate is such that at least 80 percent by weight of the aggregate has an average particle size between 40 and 150 mesh (Tyler Screen Mesh). Typically, the weight ratio of foundry aggregate to binder is from 100:1 to 100:10, preferably from 100:1 to 100:5.

Although it is possible to mix the components of the binder with the aggregate in various sequences, it is preferred to add the latent acid curing acid catalyst to the aggregate and mix it with the aggregate before adding the binder.

Curing is accomplished by heating the shaped foundry mix in a convection oven, a microwave oven, or by means of another heat source. Generally, however, curing is accomplished by injecting the foundry mix into a core box, which has been heated to a temperature sufficient to cure the foundry mix and produce a workable foundry shape. Generally, the temperature needed to cure the foundry mix is from 180°0 C. to 300° C., preferably from 200° C. to 260° C. A workable foundry shape is one that can be handled without breaking. Generally, the dwell time (the time the shaped foundry mix resides in the core box) is from 15 seconds to 120 seconds, usually from 30 seconds to 90 seconds. This is typically the cure time needed to produce a workable foundry shape. By using the binders of this invention, the dwell time is decreased.

Metal castings can be prepared from the workable foundry shapes by methods well known in the art. Molten ferrous or non-ferrous metals are poured into or around the workable shape. The metal is allowed to cool and solidify, and then the casting is removed from the foundry shape.

ABBREVIATIONS

The following abbreviations are used:

| | |
|---|---|
| BAT | bisphenol A tar |
| BHMFO | a mixture of bis-hydroxymethyl furan monomers, furfuryl alcohol, and di-methylolated furan, which contains at least 50% dimeric methylolated furan, supplied by Dynachem Inc. |
| CAT | a catalyst comprising phenol sulfonic acid, urea, polyvinyl alcohol, and water. |
| FA | furfuryl alcohol. |
| FR | a modified warm-box furan, which is the reaction product of a mixture of formaldehyde, urea formaldehyde, and furfuryl alcohol prepared under acidic conditions at a reflux temperature of 100° C., such that the ratio of urea formaldehyde to furfuryl alcohol is 0.63:1.0 and the average degree of polymerization is about 3–4. |
| PVA | polyvinyl acetate having a molecular weight average of about 20,000 sold by Monsanto Chemical under the GELVA tradename. |
| RH | relative humidity. |
| RP | resorcinol pitch, which is a solid at room temperature and has a melting point of 70° to 80° C. It is mostly dimers, trimers, and polymeric resorcinol. |
| SILANE | amino alkyl di-ethoxy silane. |

EXAMPLES

While the invention has been described with reference to a preferred embodiment, those skilled in the art will understand that various changes may be made and equivalents may be substituted for elements thereof without departing from the scope of the invention. In addition, many modifications may be made to adapt a particular situation or material to the teachings of the invention without departing from the essential scope thereof. Therefore, it is intended that the invention not be limited to the particular embodiment disclosed as the best mode contemplated for carrying out this invention, but that the invention will include all embodiments falling within the scope of the appended claims. All units are in the metric system and all amounts and percentages are by weight, unless otherwise expressly indicated. Also, all citations referred herein are expressly incorporated herein by reference.

Sand mixes were prepared by weighing 4000 grams of sand and added the catalyst and mixed for 2 minutes. Then the binder was added and mixed for 2 minutes. Finally, 2.5 g of a release agent (silane/FA blend) were added and mixed for 2 minutes.

The resulting foundry mixes were forced by air blowing the mix into a standard AFS core box (dog bone shape), which had been heated to a temperature of 205° C., unless otherwise indicated. The tensile strengths (in psi) for various samples, after being taken from the core box at specified dwell times (dwell times were 20, 30, and 40 seconds), were then measured. The hot tensile measurements were taken within 10 seconds after removing the shapes from the core box. The cold tensile strengths were measured at various intervals after removing the shapes from the corebox.

The examples show that workable foundry shapes were formed under the conditions tested. It also appeared that the foundry mixes tested had sufficient flowability.

EXAMPLES 1–2

Test Cores Prepared with Lake Sand

This shows a comparison of the hot and cold tensile strengths of test cores made with a conventional warm-box binder system (binder of Example A) with those containing BHMFO using a lake sand (Manley 1L5W sand). The binder compositions are set forth in Table I and the test results are set forth in Table II.

TABLE I (Binder formulations used with lake sand)

| | Example A | Example 1 | Example 2 |
|---|---|---|---|
| FR | 40.98 | 36.88 | 32.78 |
| FA | 40.98 | 36.88 | 32.79 |
| Water | 3.74 | 3.37 | 2.99 |
| PVA | 4.99 | 4.49 | 3.99 |
| RP | 8.99 | 8.09 | 7.19 |
| Silane | 0.32 | 0.29 | 0.26 |
| BHMFO | — | 10.00 | 20.00 |
| | 100 | 100 | 100 |

Test Conditions
Sand: Manley 1L5W sand, a lake sand
Binder: 1.25% B.O.S.
CAT: 25% B.O.B.
Temperature: ≈205° C.

TABLE II (Test results using lake sand)

| Dwell time/seconds | Example A | Example 1 | Example 2 |
|---|---|---|---|
| | Hot Tensile Strengths (psi) | | |
| 20 | 50 | 72 | 76 |
| 30 | 66 | 84 | 91 |
| 40 | 79 | 90 | 100 |
| | Cold Tensile Strengths (psi) | | |
| 20 | 202 | 254 | 300 |
| 30 | 254 | 329 | 440 |
| 40 | 322 | 398 | 433 |

The data in Table II indicate that the binders of Examples 1 and 2, containing BHMFO, produced test cores with higher hot and cold tensile strengths than the traditional warm box system (Examples A), and that higher amounts of BHMFO in the binder resulted in higher tensile strengths.

EXAMPLE 3

Test Cores Prepared with Silica Sand

In this example, silica sand was used instead of Manley 1L5W lake sand. The binders used were the binders of Example A (containing no BHMFO) and the binder described in Table III. The test results are set forth in Table IV.

TABLE III (Binder of Example 3 used with silica sand)

| | |
|---|---|
| FR | 35.49 |
| FA | 35.48 |

TABLE III-continued (Binder of Example 3 used with silica sand)

| | |
|---|---|
| Water | 1.87 |
| PVA | 2.50 |
| RP | 4.50 |
| Silane | 0.16 |
| BHMFO | 20.00 |
| | 100.00 |

Test Conditions
Sand: Badger 5574
Binder: 1.25% B.O.S.
CAT: 25% B.O.B.
Temperature: ≈205° C.

TABLE IV (Test results using silica sand)

| Dwell Time (seconds) | Example A | Example 3 |
|---|---|---|
| | Hot Tensile Strength (psi) | |
| 20 | 116 | 166 |
| 30 | 143 | 181 |
| 40 | 175 | 224 |
| | Cold Tensile Strength (psi) | |
| 20 | 398 | 463 |
| 30 | 407 | 444 |
| 40 | 422 | 408 |

The data in Table IV indicate that the binders of Example 3, containing BHMFO, produced test cores with higher hot and cold tensile strengths than the traditional warm box system (Examples A) when silica sand is used as the aggregate. Furthermore, if the results of Example 2 and 3 are compared, the data suggest that when silica sand is used, the tensile strengths of the test cores are improved when the dwell time is the same, which indicates that the cores are stronger when silica sand is used as the aggregate.

EXAMPLE 4

Test Cores Prepared with Badger Sand

Example 3 was repeated using Badger sand, a different type of silica sand. Several tests were run using different curing times. The results are set forth in Table V.

| | Cure Time (seconds) | Hot Tensile Strengths (psi) |
|---|---|---|
| | Test 1 | |
| Binder A | 25 seconds | 126 |
| Binder of Example 3 | 18 seconds | 161 |
| | Test 2 | |
| Binder A | 30 seconds | 139 |
| Binder of Example 3 | 23 seconds | 184 |

-continued

| | Cure Time (seconds) | Hot Tensile Strengths (psi) |
|---|---|---|
| | Test 3 | |
| Binder A | 40 seconds | 178 |
| Binder of Example 3 | 33 seconds | 219 |

Test Conditions
Sand: 5574 Badger
Binder: 1.25% B.O.S.
CAT: 20% B.O.B.
Temperature: ≈218° C.

These test results show that current invention can be cured 20–30% faster than the control without adversely affecting the tensile strengths of the test cores made with a binder within the scope of this invention. This is beneficial to foundries that need high productivity, because the cure time can be reduced, yet high tensile strengths can be obtained.

All of the examples demonstrate that the subject invention outperforms a conventional warm-box binder with respect to cure speed and tensile performance. These improvements allow the foundry operation to be more efficient and more productive. Thus, significant cost savings can be realized.

The invention claimed is:

1. A heat-cured furan binder system comprising:

(a) from 5 to 50 parts by weight of a furan resin;

(b) from 5 to 50 parts by weight of furfuryl alcohol;

(c) from 1 to 50 parts by weight of a dimethyolated furan selected from the group consisting of dimethylolated furan monomers, dimethyolated furan oligomers, and mixtures thereof, d) from 1 to 10 parts by weight of polyvinyl acetate; and e) from 1 to 10 parts by weight of an activator selected from the group consisting of resorcinol pitch, bisphenol A tar, and mixtures thereof, wherein said parts by weight are based upon 100 parts of binder resin.

2. The binder of claim 1, which further comprises a silane.

3. The binder of claim 2, which does not contain a polyol.

4. A foundry mix comprising in admixture:

(a) a major amount of a foundry aggregate;

(b) a catalytically effective amount of a salt of a strong inorganic or organic acid; and (c) a minor amount of a foundry binder of claims 1, 2, or 3.

5. The foundry mix of claim 4 wherein the amount of an acid curing catalyst is from 10 parts by weight to 40 parts by weight based upon 100 parts binder.

6. A process for preparing a workable foundry shape comprising:

A. forming a foundry mix of claim 5;

B. shaping the foundry mix of A into a foundry shape;

C. contacting the foundry shape of B with a source of heat at a temperature sufficient to cure said mix; and D. allowing the foundry shape to harden into a workable foundry shape.

7. A foundry shape prepared in accordance with claim 6.

* * * * *